US007360286B2

(12) United States Patent
Shimizu

(10) Patent No.: US 7,360,286 B2
(45) Date of Patent: Apr. 22, 2008

(54) CLIP FOR HANGING SKIRT

(75) Inventor: Eiji Shimizu, Fukuoka (JP)

(73) Assignee: Maruso Industry Co., Ltd., Fukuoka (JP)

( * ) Notice: Subject to any disclaimer, the term of this patent is extended or adjusted under 35 U.S.C. 154(b) by 232 days.

(21) Appl. No.: 11/189,724

(22) Filed: Jul. 27, 2005

(65) Prior Publication Data

US 2007/0007313 A1 Jan. 11, 2007

(30) Foreign Application Priority Data

Jun. 23, 2005 (JP) ..... 2005-004807 U

(51) Int. Cl.
*A41F 1/00* (2006.01)
*A41D 27/22* (2006.01)

(52) U.S. Cl. ..... 24/555; 24/556; 24/561; 24/568; 223/95; 223/96

(58) Field of Classification Search ..... 24/535, 24/536, 538, 542–546, 555, 557, 558, 563, 24/568, 570; 223/85, 88, 91, 95, 96
See application file for complete search history.

(56) References Cited

U.S. PATENT DOCUMENTS 2,408,145 A * 9/1946 Johnson ..... 223/96
3,626,553 A * 12/1971 Darney et al. ..... 280/814
3,744,686 A * 7/1973 Levitin ..... 223/96
4,493,495 A * 1/1985 Linn ..... 281/45
4,902,078 A * 2/1990 Judd ..... 312/7.2
5,104,088 A * 4/1992 Bakanowsky, III ..... 248/442.2
5,361,948 A * 11/1994 Batts ..... 223/96

(Continued)

FOREIGN PATENT DOCUMENTS

JP 6-86657 12/1994

(Continued)

*Primary Examiner*—Robert J. Sandy
*Assistant Examiner*—Ruth C Rodriguez
(74) *Attorney, Agent, or Firm*—Wenderoth, Lind & Ponack, L.L.P.

(57) ABSTRACT

A clip for hanging a skirt that can be attached to an existing hanger. The distance between clips can be freely adjusted to hang, skirts from small children's to large adult sizes without causing creases. The clip neither damages cloth of a skirt nor leaves marks on a skirt while preventing a skirt from slipping off a hanger. Furthermore, the clip for hanging a skirt is very small in volume and of low-cost. The clip for hanging a skirt includes a plate-like connecting piece (2), first and second pinching pieces (3) and (4) having smooth inside surfaces which are movably connected to both ends of the connecting piece (2) at positions under upper ends of the first and second pinching pieces, a vertical piece (5) downwardly extending from a center of the connecting piece (2) and having two protrusions (6) and (7) on a lower end portion of the vertical piece (5) each of the protrusions being directed to an inner side of each of the first and second pinching pieces (3 and 4), and a lock piece (8) foldably connected to an upper end of the first pinching piece (3). The lock piece (8) maintains the inside surfaces of the first and second pinching pieces (3 and 4) to be pressed toward the protrusions (6 and 7) by engaging the lock piece (8) with an upper end portion of the second pinching piece (4).

5 Claims, 5 Drawing Sheets

U.S. PATENT DOCUMENTS

| | | | | |
|---|---|---|---|---|
| 5,595,331 | A * | 1/1997 | Leistner | 223/91 |
| 6,575,513 | B2 * | 6/2003 | Pikel | 294/159 |
| 2006/0218759 | A1 * | 10/2006 | Wierzbicki | 24/545 |

FOREIGN PATENT DOCUMENTS

| | | |
|---|---|---|
| JP | 3047112 | 1/1998 |
| JP | 2000-107015 | 4/2000 |

* cited by examiner

CLIP FOR HANGING SKIRT

BACKGROUND OF THE INVENTION

1. Field of the Invention

This invention relates to a clip for hanging a skirt used to suspend a skirt after cleaning for storage, which is attached to a shoulder portion of an existing garment hanger such as a wire hanger.

2. Description of the Related Art

In laundries, a skirt is hung on a hanger after cleaning for a customer. The skirt is sometimes folded at the middle part of the length and hung over a crossbar of a hanger. However, this is not the preferable method as it leaves a crease in a skirt. There is also the type of hanger that has horizontal bars for hanging loops sewn on a skirt. The bars of this type of hanger are made straight in a horizontal direction, which makes it easier for loops to slide along the bars. Therefore, loops on both sides of a skirt often move toward the center of a hanger, or a skirt slides down when a hanger is tilted.

In view of the foregoing, other various types of garment hangers have been proposed. For example, there is a hanger that fixes a waistband of a skirt or a hanger provided with a clip that pinches a skirt to be suspended.

In the United States, a wire hanger with a paper-made cover attached on front and back sides of the hanger is often used for hanging garments after cleaning. To suspend a skirt, as shown in FIG. 7, a paper cover 21 on a wire hanger 20 and a waistband of a skirt S are pierced with a safety pin 22, or a claw of a aluminum clip 23 is used to hold a skirt FIG. 7 shows the safety pin 22 and the clip 23 provided on either side of one hanger. In actual use, two of either the safety pin 22 or the clip 23 are used.

The safety pin 22 and the clip 23, however, puncture the cloth of a skirt and thus leave a hole on some kinds of fabrics or can break the fibers to cause damage. These problems lead to troubles with customers. Moreover, the safety pin 22 and the clip 23 which have pointed ends like a needle may injure a person who handles them. In the former hanger, it is also troublesome and time-consuming to stick the safety pin 22 into a waistband of a skirt and then put a limb of the pin into a cap.

In Japan, a clip for suspending a skirt is used. The clip is attached to a hanger such as a wire hanger having a member for hanging trousers. Examples of such a clip are disclosed in Unexamined Japanese Utility Model Publication No. Hei 6-86657 and Unexamined Japanese Patent Publication No. 2000-107015.

In Publication of Japanese Registered Utility Model No. 3047112, disclosed is a skirt hanger provided with a two-forked clip member pressed onto the outside of an inserting portion having a protrusion for preventing a skirt from slipping off.

In the clips disclosed in Unexamined Japanese Utility Model Publication No. Hei 6-86657 and Unexamined Japanese Patent Publication No. 2000-107015, the pinching force of the clips must be considerable to prevent a suspended skirt from falling off. Thus, the clips are required to be of a certain size. Furthermore, the clips have a notched portion inside a pinching member or a claw to hold a skirt, thereby increasing frictional force between the clips and the surface of a waistband of a skirt. Such hardware may leave marks on a waistband of a skirt which deteriorates the quality of cleaned garments, and leads to customer complaints.

The skirt hanger disclosed in Publication of Japanese Registered Utility Model No. 3047112 needs to be formed with an inserting portion having a protrusion and a clip member. Therefore, the clip member cannot be attached to a commercially available wire hanger or a plastic hanger. Moreover, since the distance between the two clips for pinching a skirt is fixed, side portions of a skirt with a large width droop, and some small skirts for children cannot be hung. There is also a type of hanger that has a freely movable clip, which is, however, expensive.

In view of the above, an object of the present invention is to provide a clip for hanging a skirt which can be attached to an existing hanger. The distance between the clips can be freely adjusted, thereby hanging various skirts from small ones for children to large adult sizes without causing creases. The clip of the present invention neither damages the cloth of a skirt nor leaves marks on a skirt while preventing a skirt from slipping off a hanger. Furthermore, the clip for hanging a skirt is small and inexpensive.

SUMMARY OF THE INVENTION

In order to solve the above problems, a clip for hanging a skirt according to the present invention comprises a plate-like connecting piece, first and second pinching pieces having smooth inside surfaces which are movably connected to both ends of the connecting piece at positions under upper ends of the first and second pinching pieces, a vertical piece downwardly extending from the center of the connecting piece and having two protrusions on a lower end portion of the vertical piece, each of the protrusions being directed to an inner side of each of the first and second pinching pieces, and a lock piece foldably connected to an upper end of the first pinching piece, said lock piece maintaining the inside surfaces of the first and second pinching pieces to be pressed toward the protrusions by engaging the lock piece with an upper end portion of the second pinching piece.

In the present invention, two clips with one each on both shoulder portions of an existing hanger are used to suspend a skirt by pinching a waistband on the right and left sides of the skirt.

Firstly, a lock piece of the clip for hanging a skirt is kept in an open state. The clip is attached so that a vertical piece is inserted into the inside of one end portion of the waistband of the skirt which is double layered with front and back sides and each of a first and second pinching piece is placed outside of the front and back sides of the skirt on the waistband. A shoulder portion of the hanger is inserted together between the vertical piece and the pinching piece on the back side. Next, with the lock piece, lower portions of the pinching pieces are closed and kept closed by engaging the lock piece. The same operation is carried out on the other end portion of the waistband of the skirt, and the waistband of the skirt is fixed onto both of the shoulder portions of the hanger to suspend the skirt.

As described above, the skirt is hung on the hanger with two clips, which makes the protrusions perpendicularly abut on the cloth inside the waistband of the skirt. On the outer sides, both front and back sides of the skirt are pressed at the waistband by the first and second pinching pieces.

Accordingly, the cloth on the front and back sides outside the waistband of the skirt is not damaged and is free from marks caused by clamping while the skirt can be securely fixed and suspended on the hanger.

As two clips for hanging a skirt are attached to shoulder portions of a hanger which form a mountain shape, a waistband of a skirt is stretched in a horizontal direction when weight of the skirt is on the clips, which causes no creases on the skirt.

The lock piece may be provided with a cam portion. When the lock piece is engaged with an upper end portion of a second pinching piece with an upper end portion of a first pinching piece to which the lock piece is connected functioning as a hinge, the cam portion outwardly presses the upper end portion of the second pinching piece, thereby driving lower portions of the first and second pinching pieces toward a closing direction. By this structure, an operation of pinching a waistband of a skirt and a locking operation by the lock piece can be carried out in the same motion, which enables a waistband of a skirt to be fixed with a single operation.

At a distal end of the lock piece, a convex portion which serves as a guide when releasing an engaging state of the first and second pinching pieces may be formed. With the convex portion, a skirt can be removed from a hanger with a single operation.

DETAILED DESCRIPTION OF THE PREFERRED EMBODIMENT

An embodiment of the present invention will be described in detail with reference to the accompanying drawings.

Figure 1:
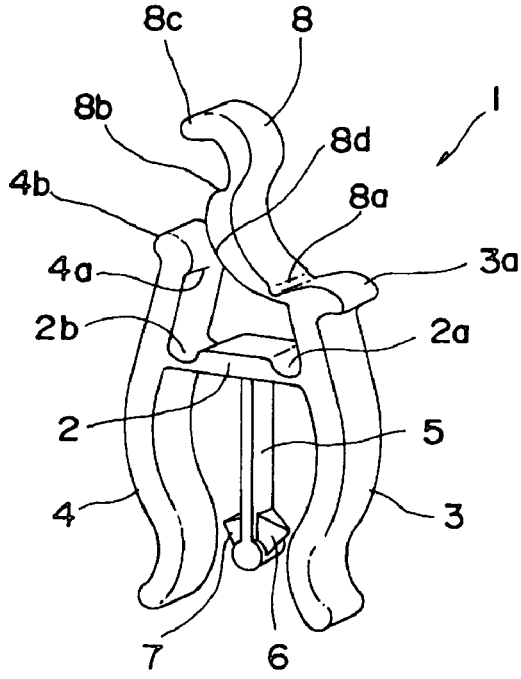
FIG. 1 is a perspective view illustrating a clip for hanging a skirt according to an embodiment of the present invention.
Figure 2:
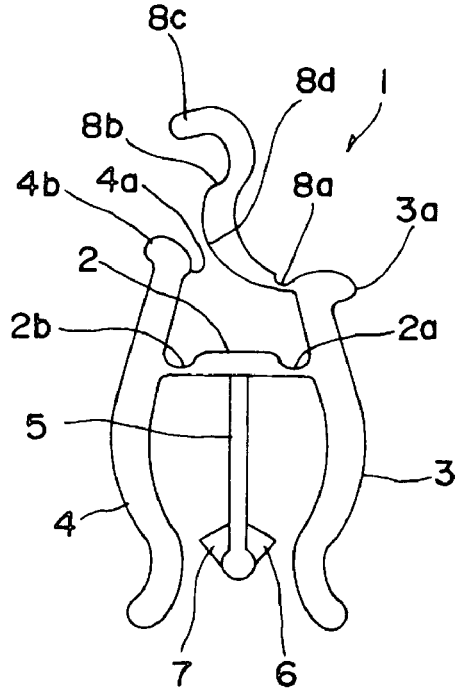
FIG. 2 is a front view of the clip for hanging a skirt according to the embodiment of the present invention.
Figure 3:
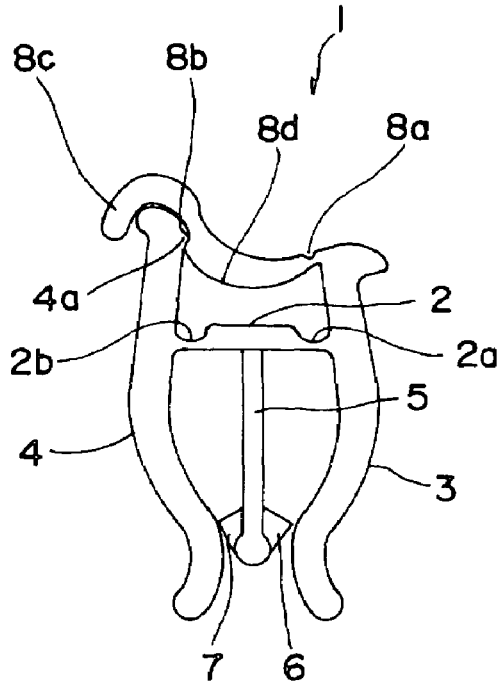
FIG. 3 is a front view of the clip for hanging a skirt according to the embodiment of the present invention in which pinching pieces are closed.

FIG. 1 is a perspective view illustrating a clip for hanging a skirt according to an embodiment of the present invention, FIG. 2 is a front view thereof, and FIG. 3 is a front view in a state where pinching pieces are closed.

In these drawings, a clip 1 comprises a plate-like connecting piece 2, first and second pinching pieces 3 and 4 which are movably connected to both ends of the connecting piece 2 at positions under upper ends of the pinching pieces 3 and 4, a vertical piece 5 downwardly extending from a center of the connecting piece 2 and having two protrusions 6 and 7 on a lower end portion of the vertical piece 5, each of the protrusions 6 and 7 being directed to an inner side of each of the first and second pinching pieces 3 and 4, a lock piece 8 foldably or pivotally connected to an upper end of the first pinching piece 3, the lock piece 8 maintaining the inside surfaces of the first and second pinching pieces 3 and 4 pressed toward the protrusions 6 and 7 by engaging the lock piece 8 with an upper end of the second pinching pieces 4. Thin-walled portions 2*a* and 2*b* are formed between the connecting piece 2 and the pinching pieces 3 and 4 to make the clip 1 bendable at these portions. A base end portion of the lock piece 8 also has a thin-walled portion 8*a*, where the clip 1 is bendable.

In the vicinity of a distal end portion of the lock piece 8, an engaging depressed portion 8*b* is formed. In the vicinity of a distal end portion of the second pinching piece 4, an engaging protruding portion 4*a* is formed. A convex portion 8*c* is provided on the distal end of the lock piece 8, which is pushed up with fingers when releasing the lock. The lock piece 8 is further provided with a cam portion 8*d*. When the lock piece 8 is closed with the thin-walled portion 8*a* functioning as a hinge, the cam portion 8*d* outwardly presses the distal end portion of the second pinching piece 4, thereby driving a lower end portion of the second pinching piece 4 in a closing direction with the thin-walled portion 2*b* functioning as a hinge. In the vicinity of distal end portions of the pinching pieces 3 and 4, tabs 3*a* and 4*b* are provided which are easily held by fingers when opening the clip 1. By opening the clip 1, a hanger and a skirt can be smoothly pinched at the same time. The clip 1 is integrally formed from thermoplastic resin such as polypropylene, polyethlene or the like.

Figure 4:
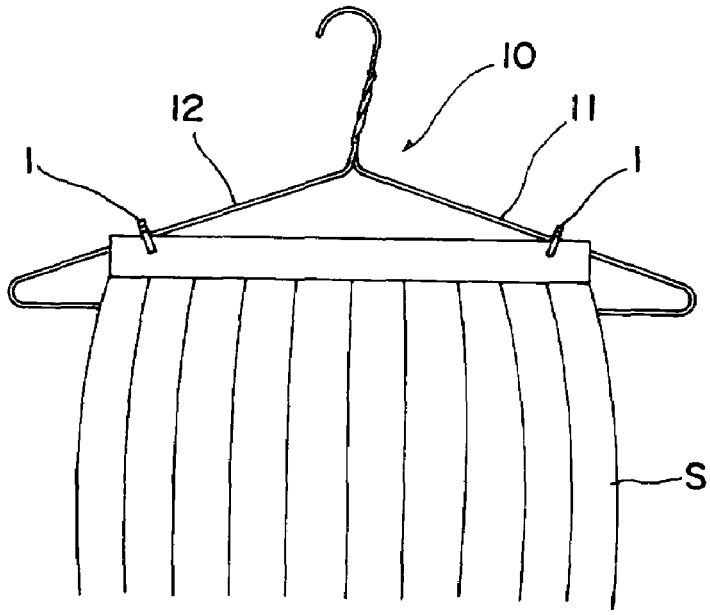
FIG. 4 is a front view illustrating a state where a skirt is suspended with the clip for hanging a skirt according to the embodiment of the present invention.
Figure 5:
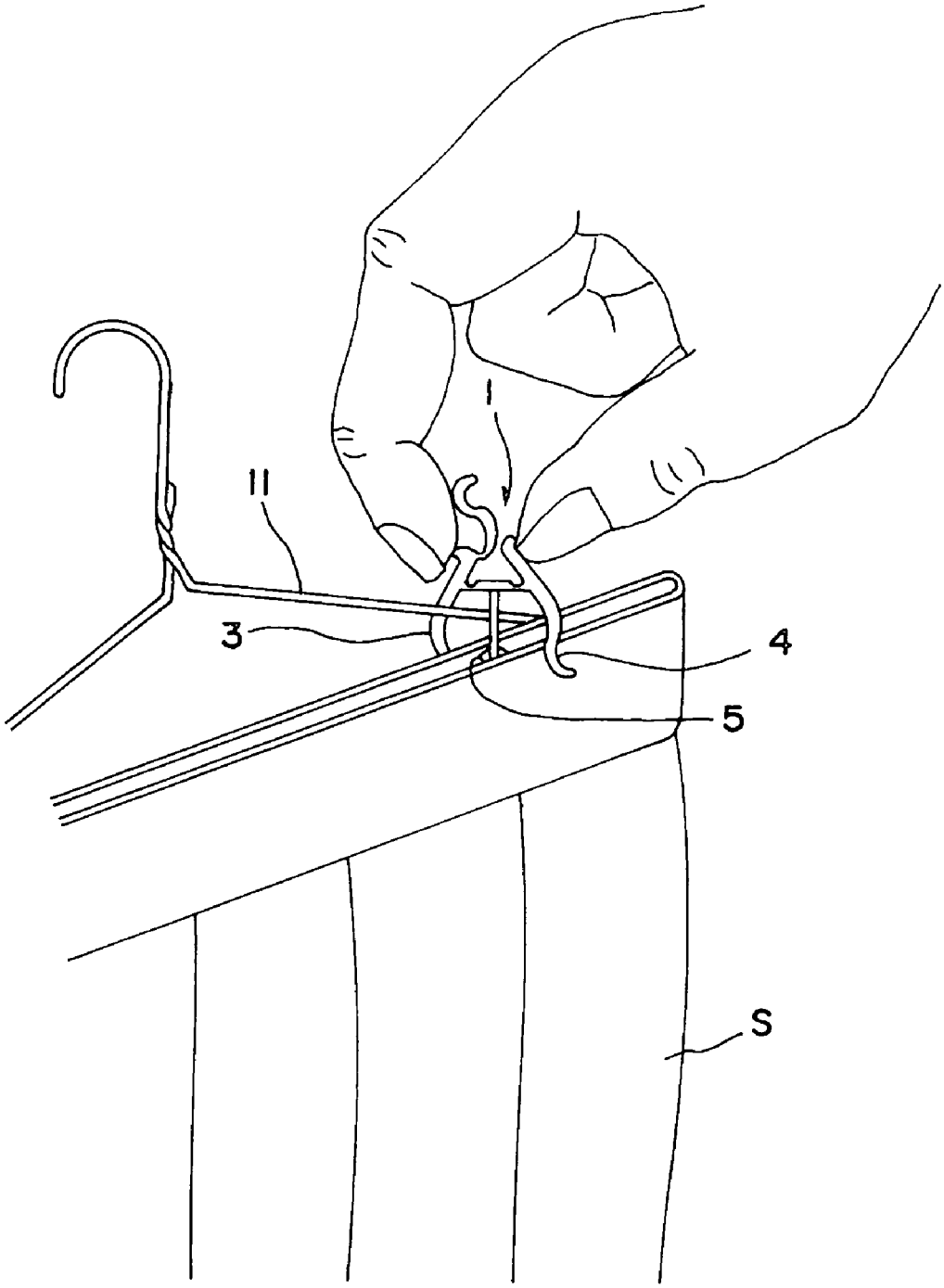
FIG. 5 is an explanatory view illustrating a state where the clip for hanging a skirt according to the embodiment of the present invention is opened with fingers and attached to a hanger and a skirt.
Figure 6:
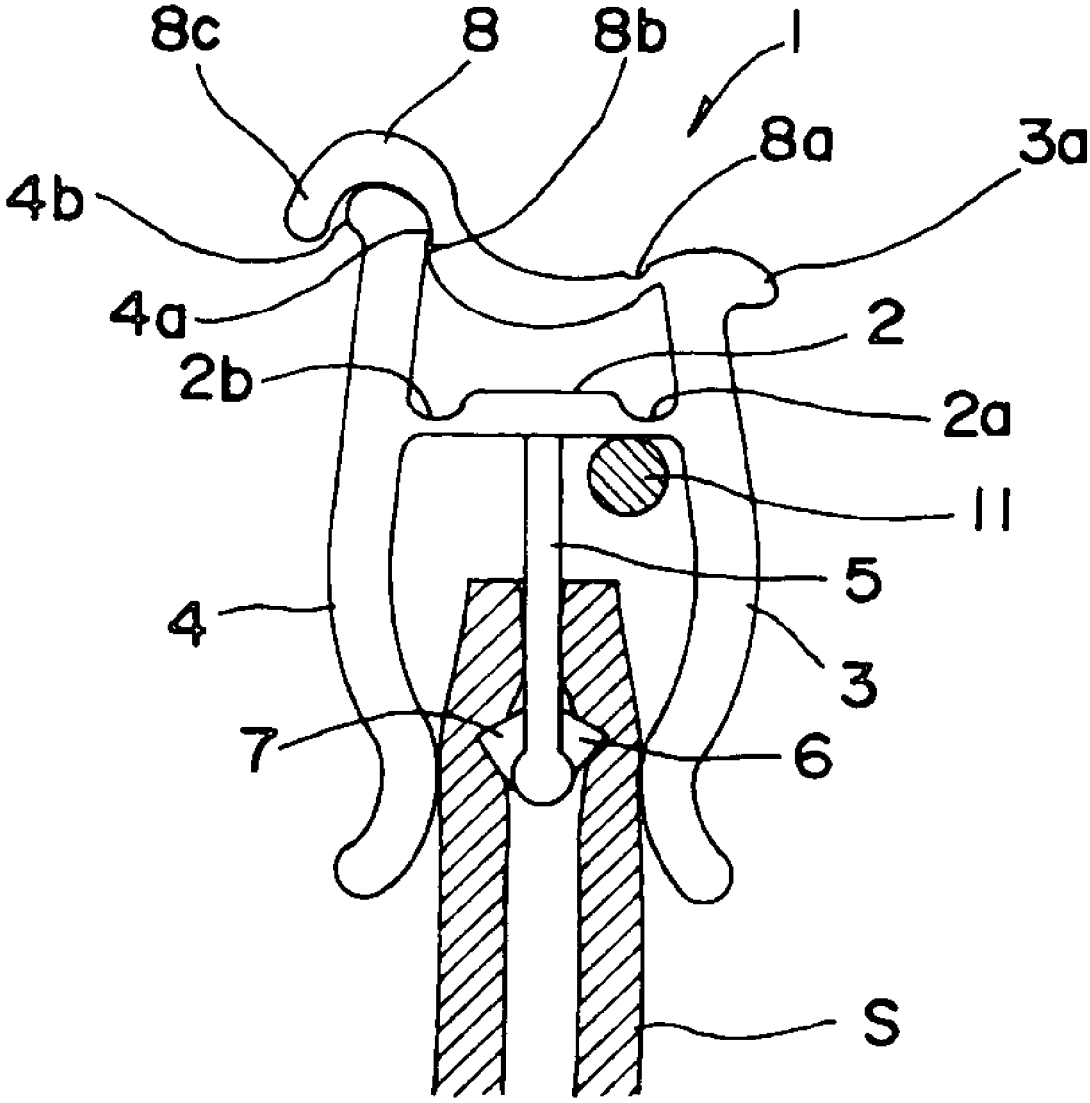
FIG. 6 is a sectional view illustrating a state where a skirt is pinched by the clip for hanging a skirt according to the embodiment of the present invention.
Figure 7:
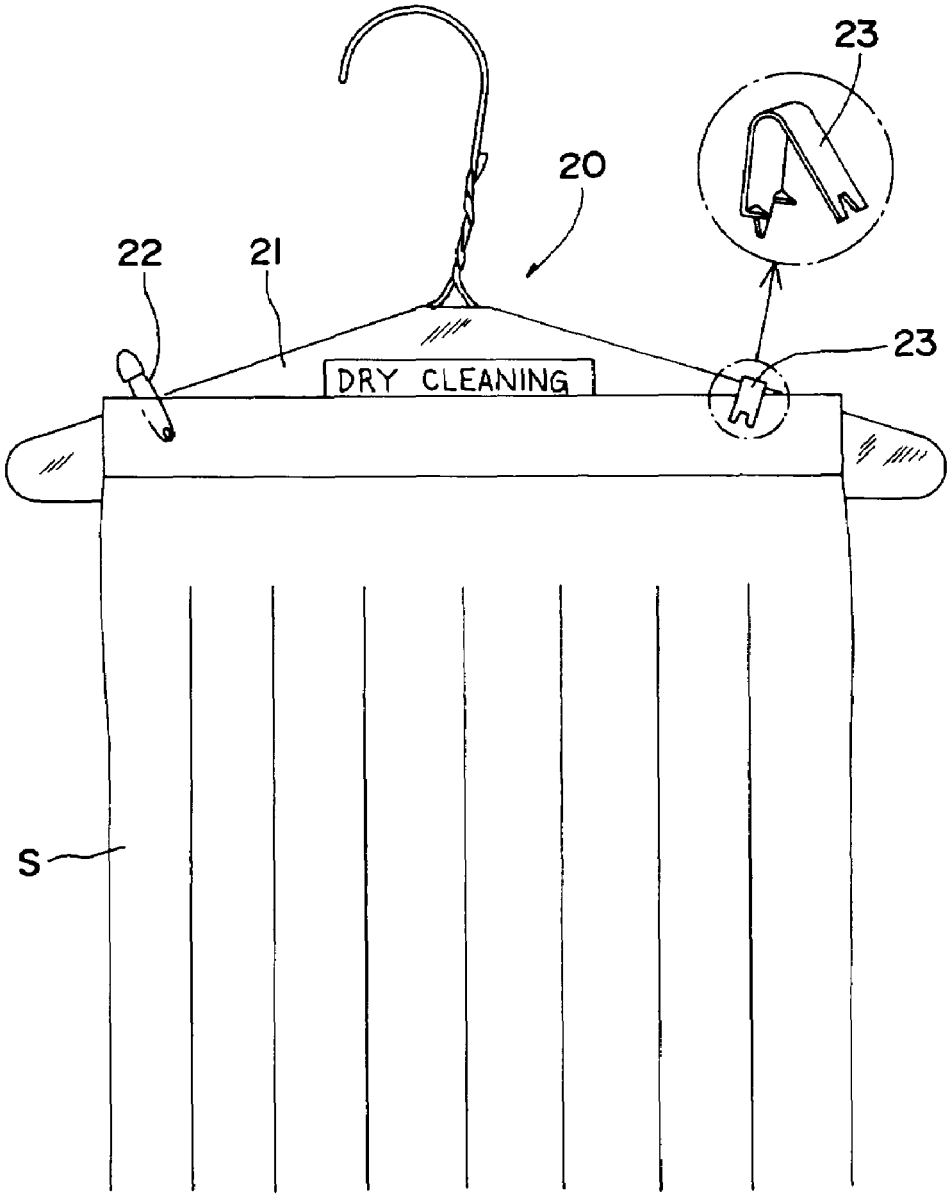
FIG. 7 is a front view illustrating a a state where a skirt is suspended with a safety pin and a clip according to a conventional method.

Next, referring to FIGS. 4 to 6, steps for hanging a skirt on a wire hanger using the clip 1 are explained below. FIG. 4 is a front view illustrating a state where a skirt is suspended with the clip for hanging a skirt of the embodiment of the present invention, FIG. 5 is an explanatory view illustrating a state where the clip for hanging a skirt is opened with fingers and attached to a hanger and a skirt, and FIG. 6 is a sectional view illustrating a state where a skirt is pinched by the clip. In the drawings, 10 denotes a wire hanger, and 11 and 12 denote shoulder portions of the wire hanger 10.

Firstly, as shown in FIGS. 1, 2 and 5, the lock piece 8 of the clip for hanging a skirt 1 is released, and the tabs 3*a* and 4*b* are pushed with fingers to open the first and second pinching pieces 3 and 4. The clip 1 is attached so that the vertical piece 5 is inserted into an inside of one end portion of the wastband of the skirt S which is double layered with front and back sides, and each of the first and second pinching pieces 3 and 4 is placed outside of the front and back sides of the skirt S on the waistband, respectively. The shoulder piece 11 of the hanger is inserted between the first pinching piece 3 on the backside and the vertical piece 5. Then, lower parts of the pinching piece 3 and 4 are closed using the lock piece 8, and the engaging depressed portion 8*b* of the lock piece 8 is engaged with the engaging protruding portion 4*a* of the pinching piece 4 to keep the pinching pieces 3 and 4 closed. In other words, the first and second pinching pieces 3 and 4 clamp the waistband of the skirt S to generate a reaction force to a releasing direction. Thus, a force to close upper portions of the pinching pieces 3 and 4 is generated with the thin-walled portions 2*a* and 2*b* as fulcrums. However, the lock piece 8 prevents the upper portions of the pinching pieces 3 and 4 from closing, thereby keeping the pinching pieces 3 and 4 closed.

The above steps are carried out on the other end portion of the waistband of the skirt S to fix the waistband of the skirt on the shoulder portion 12 on the other side of the wire hanger 10.

As described above, by hanging the skirt on the wire hanger 10 with the two clips 1, the protrusions 6 and 7 perpendicularly abut on the cloth inside the waistband of the skirt S. On the outer sides, both front and back sides of the skirt S are pressed at the waistband by the first and second pinching pieces 3 and 4.

Thus, the skirt S can be securely fixed and suspended from the wire hanger 10 without damaging the cloth on the front and back sides of the skirt nor leaving marks due to clamping. As the clip 1 is held on both of the shoulder parts 11 and 12 of the wire hanger 10, the two clips 1 do not move toward the center of the hanger to keep the waistband of the skirt S tensed in a horizontal direction.

When removing the skirt S from the wire hanger 10, the convex portion 8*c* is pushed up so that the engaging depressed portion 8*b* is disengaged from the engaging protruding portion 4*a* to release the pinching pieces 3 and 4, thereby removing the skirt S.

In the foregoing explanation, an example employing a wire hanger as an existing hanger is described. However, any type of hanger with shoulder portions can be used. A wire hanger with a paper cover is applicable as well.

The present invention can be attached to an existing hanger. Therefore, the distance between the clips can be freely adjusted, thereby hanging skirts from children's to large adult sizes without causing creases. The clip of the present invention neither damages cloth of a skirt nor leaves marks on a skirt while preventing a skirt from slipping out from a hanger. Furthermore, the clip for hanging a skirt is so small in volume that the clip can be utilized as a low-cost clip for hanging a skirt.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A clip for hanging a skirt, comprising:

a connecting piece having first and second ends;

a first pinching piece having first and second end portions, said first pinching piece being movably connected to the first end of said connecting piece;

a second pinching piece having first and second end portions, said second pinching piece being movably connected to the second end of said connecting piece;

a vertically extending piece having a vertical member connected to said connecting piece and garment engaging portions that project perpendicularly from said vertical member;

a lock piece having first and second end portions, the first end portion being pivotally connected to the first end portion of said first pinching piece and the second end portion being configured to alternately engage and disengage the first end portion of said second pinching piece;

wherein said lock piece and said second pinching piece are configured to move independently of one another when said lock piece is disengaged from the first end portion of said second pinching piece; and wherein said lock piece maintains the second end portion of said first pinching piece and the second end portion of said second pinching piece pressed toward said garment engaging portions when the second end portion of said lock piece is engaged with the first end portion of said second pinching piece.

2. The clip according to claim 1, wherein said lock piece has a cam portion which outwardly presses the first end portion of the second pinching piece, thereby driving lower portions of the first and second pinching pieces toward a closing direction when said lock piece is engaged with the first end portion of said second pinching piece, wherein the first end portion of said first pinching piece to which said lock piece is movably connected functions as a hinge.

3. The clip according to claim 1, wherein said lock piece has a convex portion at a distal end of said lock piece, the convex portion serving as a guide for disengaging said lock piece from the first end portion of said second pinching piece.

4. The clip according to claim 2, wherein said lock piece has a convex portion at a distal end thereof, the convex portion serving as a guide for disengaging said lock piece from the first end portion of said second pinching piece.

5. The clip according to claim 1, wherein said clip is integrally formed from thermoplastic resin.

* * * * *